US008931128B2

(12) United States Patent
Kiser

(10) Patent No.: US 8,931,128 B2
(45) Date of Patent: Jan. 13, 2015

(54) ENCAPSULATED AND FILTERED MATTRESS

(75) Inventor: Mark Kiser, Granite Falls, NC (US)

(73) Assignee: MTJ American LLC, Granite Falls, NC (US)

( * ) Notice: Subject to any disclaimer, the term of this patent is extended or adjusted under 35 U.S.C. 154(b) by 607 days.

(21) Appl. No.: 13/038,861

(22) Filed: Mar. 2, 2011

(65) Prior Publication Data

US 2011/0154575 A1 Jun. 30, 2011

Related U.S. Application Data

(63) Continuation-in-part of application No. 11/811,714, filed on Jun. 12, 2007.

(60) Provisional application No. 61/339,264, filed on Mar. 2, 2010, provisional application No. 60/812,772, filed on Jun. 12, 2006.

(51) Int. Cl.

| | |
|---|---|
| ***A47C 27/00*** | (2006.01) |
| ***A47C 27/12*** | (2006.01) |
| ***A47C 27/14*** | (2006.01) |

(52) U.S. Cl.

CPC ..... *A47C 27/002* (2013.01); *A47C 27/007* (2013.01); *A47C 27/008* (2013.01); *Y10S 5/952* (2013.01); *Y10S 5/953* (2013.01)

USPC ..... 5/690; 5/740; 5/655.9; 5/952; 5/953; 5/737

(58) Field of Classification Search

USPC ..... 5/737, 690, 740, 655.9, 953, 952, 702, 5/911, 655.4, 654, 644, 655.3, 706, 710, 5/655.5, 909, 724, 652.1

See application file for complete search history.

(56) References Cited

U.S. PATENT DOCUMENTS

| | | | | |
|---|---|---|---|---|
| 460,439 | A | 9/1891 | Hildreth | |
| 563,225 | A | 6/1896 | Forsberg | |
| 712,720 | A | 11/1902 | Richardson | |
| 877,692 | A | 1/1908 | Wyman | |
| 931,361 | A | 8/1909 | Weinberg | |
| 953,551 | A | 3/1910 | Quick | |
| 969,840 | A | 9/1910 | Burton | |
| 1,648,373 | A | 11/1927 | Vilas | |
| 1,691,629 | A | 11/1928 | Kusterle | |
| 1,963,318 | A | 6/1934 | Wolf | |
| 2,139,803 | A | 12/1938 | Cavicchi | |
| 2,246,831 | A | 6/1941 | Bechik | |
| 2,712,656 | A | 7/1955 | Radzik | |
| 2,766,465 | A | 10/1956 | Radzik | |
| 4,087,874 | A | 5/1978 | Callaway | |
| 4,843,666 | A | 7/1989 | Elesh | |
| 4,885,811 | A * | 12/1989 | Hayes | 5/81.1 T |
| 5,001,792 | A * | 3/1991 | Strobel | 5/675 |
| 5,033,133 | A * | 7/1991 | Nissen | 5/653 |
| 5,274,846 | A * | 1/1994 | Kolsky | 2/460 |
| 5,388,295 | A * | 2/1995 | Sarkozi | 5/630 |
| 5,640,725 | A | 6/1997 | Ando | |
| 6,219,867 | B1 * | 4/2001 | Yates | 5/655.5 |
| 6,260,222 | B1 * | 7/2001 | Lin | 5/709 |
| 6,351,864 | B1 | 3/2002 | Karafa | |

(Continued)

*Primary Examiner* — Robert G Santos

(74) *Attorney, Agent, or Firm* — Faegre Baker Daniels LLP

(57) ABSTRACT

A mattress for use in institutions, such as correctional facilities, detention centers, rehabilitation centers, hospitals and the like, includes a core formed of a transparent or translucent padding material and a transparent or translucent covering surrounding the core.

14 Claims, 11 Drawing Sheets

(56) References Cited

U.S. PATENT DOCUMENTS

| | | | | |
|---|---|---|---|---|
| 6,516,482 | B2 | 2/2003 | Karafa | |
| 6,651,277 | B1 | 11/2003 | Marson | |
| 6,701,558 | B2 | 3/2004 | VanSteenburg | |
| 6,785,923 | B2 | 9/2004 | Karafa | |
| 6,952,851 | B1 * | 10/2005 | Mahoney | 5/690 |
| 6,990,701 | B1 * | 1/2006 | Litvak | 5/723 |
| 7,076,823 | B2 * | 7/2006 | Downey | 5/716 |
| 7,086,108 | B1 * | 8/2006 | Litvak | 5/723 |
| 8,056,169 | B2 * | 11/2011 | McManamy et al. | 5/699 |
| 2004/0255379 | A1 | 12/2004 | Zheng | |
| 2005/0160535 | A1 * | 7/2005 | Downey | 5/716 |
| 2005/0262642 | A1 * | 12/2005 | Miller | 5/737 |
| 2006/0075566 | A1 * | 4/2006 | McManamy et al. | 5/690 |
| 2007/0094808 | A1 | 5/2007 | Jansen | |
| 2007/0283498 | A1 | 12/2007 | Shelby | |
| 2008/0005845 | A1 | 1/2008 | Pfleger | |
| 2010/0287708 | A1 * | 11/2010 | Shelby | 5/737 |
| 2011/0154575 | A1 * | 6/2011 | Kiser | 5/706 |
| 2012/0079659 | A1 * | 4/2012 | Loos | 5/636 |

* cited by examiner

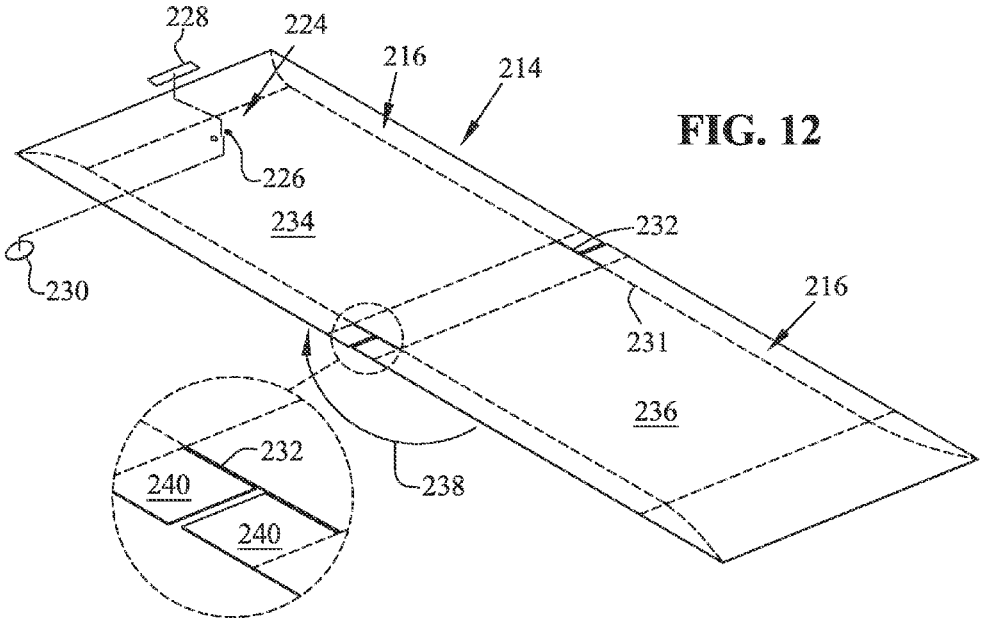
FIG. 12
FIG. 13
FIG. 14
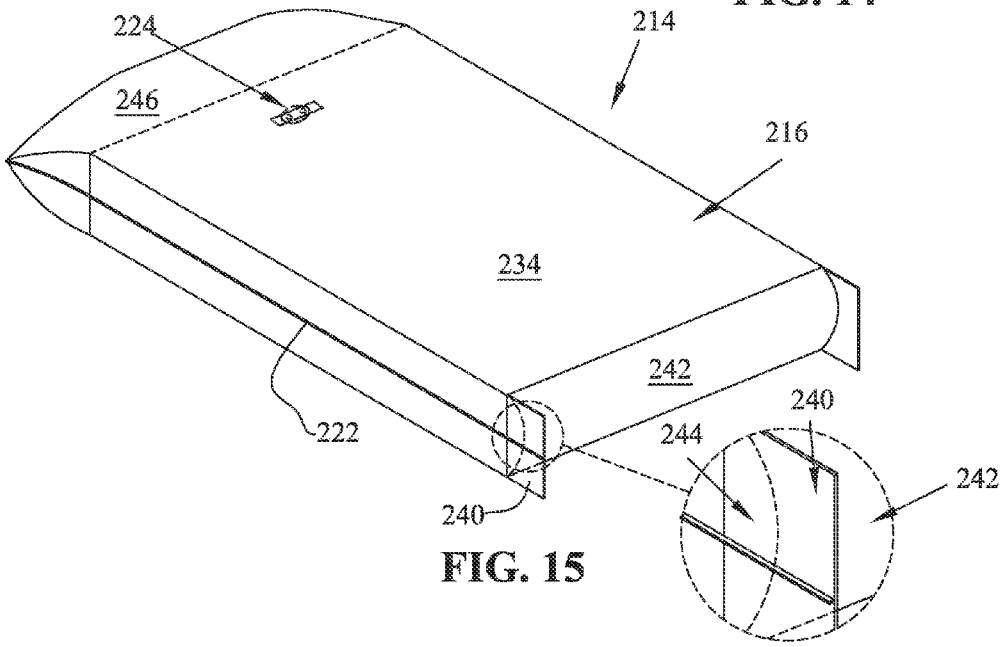
FIG. 15

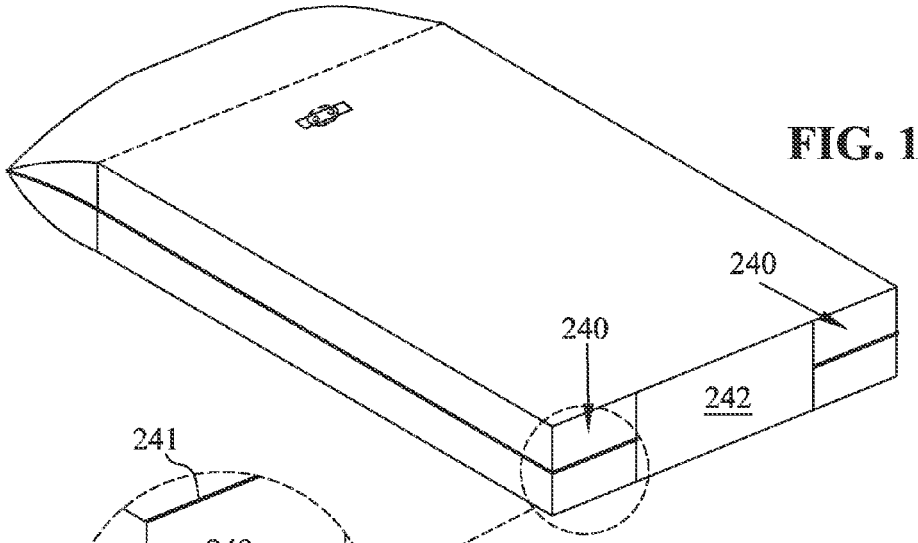
FIG. 16
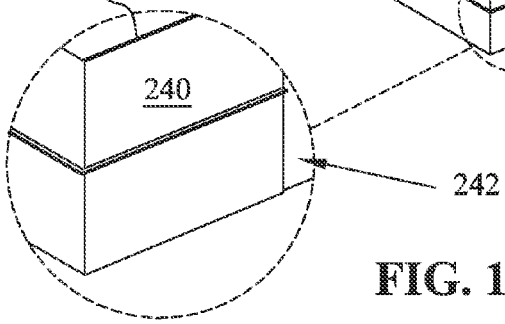
FIG. 17
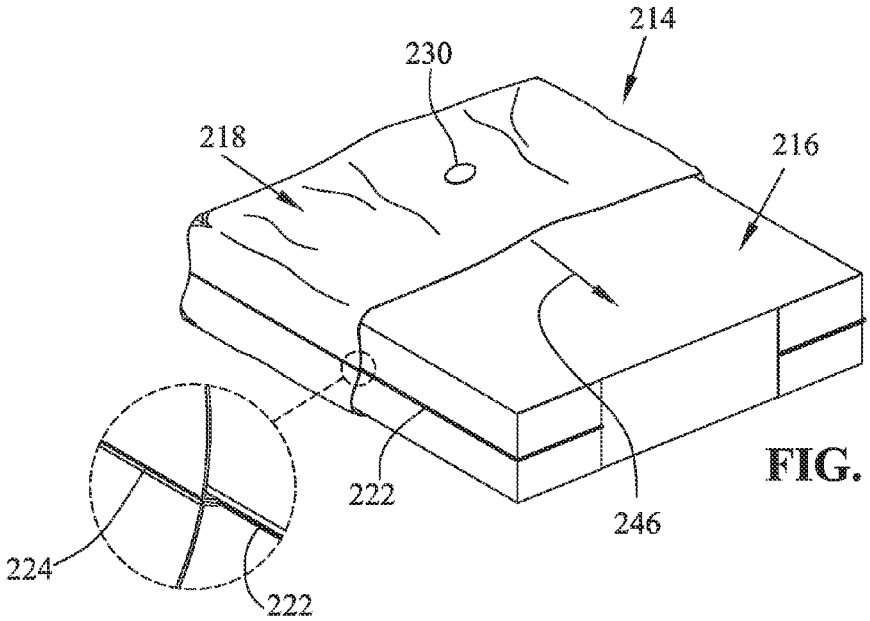
FIG. 18
FIG. 19

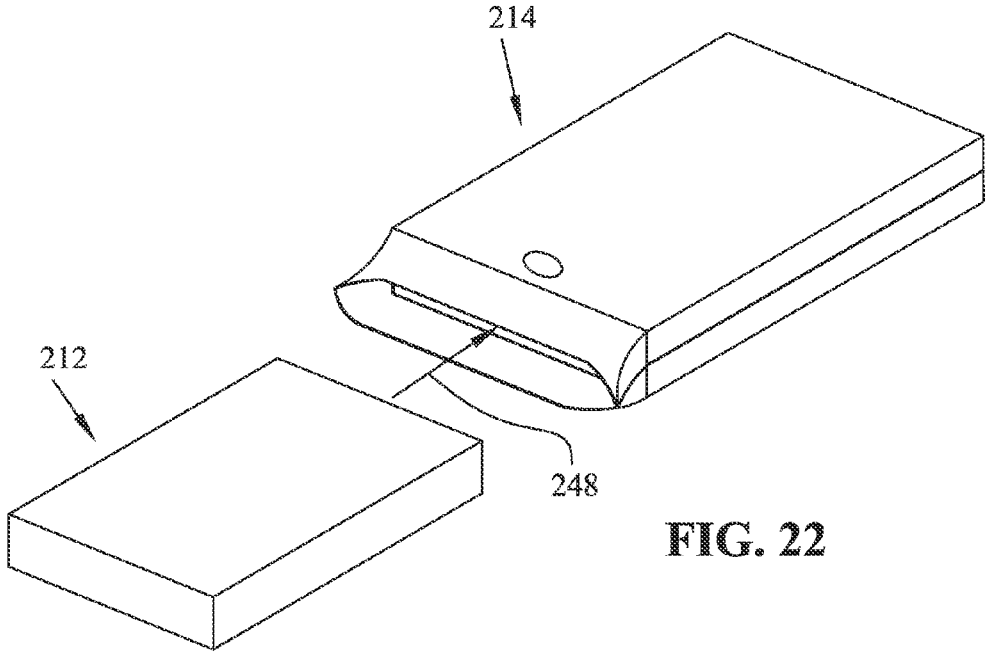
FIG. 22
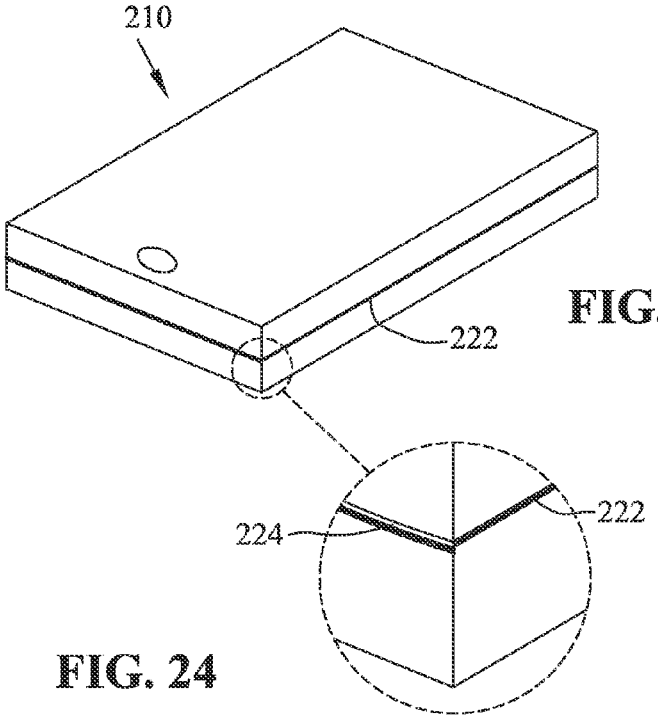
FIG. 23
FIG. 24

ENCAPSULATED AND FILTERED MATTRESS

This application claims priority to application Ser. No. 61/339,264 filed Mar. 2, 2010, and is a Continuation-in-Part of application Ser. No. 11/811,714 filed Jun. 12, 2007, which in turn claims priority from Provisional Patent Application Ser. No. 60/812,772 filed Jun. 12, 2006, the disclosures of which are fully incorporated herein by reference.

BACKGROUND

The present invention relates to mattresses used in institutions, such as correctional facilities, detention centers, rehabilitation centers, hospitals and the like, and, more particularly, to mattresses that resist and detect tampering, tearing and alteration.

Institutions, such as correctional facilities, jails, penitentiaries, detention centers, rehabilitation centers, hospitals and the like, house numerous people overnight. Accordingly, these institutions must provide bedding for each inmate, patient or guest. Such bedding typically includes a mattress supported on a metal frame and having a fabric covering sewn together at the seams. Unfortunately, some inmates, patients or guests of these institutions have a propensity to destroy or damage the mattress to which they are assigned by ripping and tearing the covering of the mattress. In addition, many inmates, patients or guests use their mattress to conceal contraband, such as drugs, weapons and the like, by tearing a small slit in the covering of the mattress and inserting the contraband inside the mattress. Such tears and slits may be taped, glued or otherwise closed making it difficult to see and detect the tear in the fabric covering of known mattresses. As a result, it may be a challenge for the institution's staff to detect the alteration of the mattress and find the contraband.

Accordingly, benefits may be obtained from a mattress having an improved tear-resistant covering and a mechanism for detecting alterations, tears and/or contraband in the mattress.

The present invention also relates to mattresses including vents which provide ventilation. Ventilation is beneficial to transfer heat or humidity, such as water vapor. Water vapor within a mattress may damage the structure of the mattress. Accordingly, benefits may be obtained from a mattress including a vent.

Additionally, it would be advantageous to see into the mattress to see the contraband that is concealed, or to prevent the opportunity to conceal it.

SUMMARY

The present invention provides mattresses for use in institutions, such as correctional facilities, detention centers, rehabilitation centers, hospitals and the like, where the mattress comprises a core formed of a padding material, the padding material being comprised of a transparent or translucent materiel; and a transparent or translucent covering surrounding said core.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 12 is an exploded view of a mattress according to another embodiment of the present invention;

FIG. 13 is an enlarged view of the encircled region of the mattress of FIG. 12;

FIG. 14 is a perspective view of the mattress of FIG. 12 wherein the cover has been folded;

FIG. 15 is an enlarged view of the encircled region of the mattress of FIG. 14;

FIG. 16 is a perspective view of the mattress of FIG. 14 wherein the flaps are adjacent to the rest of the cover;

FIG. 17 is an enlarged view of the encircled region of the mattress of FIG. 16;

FIG. 18 is a perspective view of the mattress of FIG. 16 wherein the cover is partially inverted;

FIG. 19 is an enlarged view of the encircled region of the mattress of FIG. 18;

FIG. 22 is a perspective view of the mattress of FIG. 18 wherein the core is configured to be inserted within the cover;

FIG. 23 is a perspective view of the mattress of FIG. 22 wherein the core is inserted within the cover;

FIG. 24 is an enlarged view of the encircled region of the mattress of FIG. 23;

Figure 1:
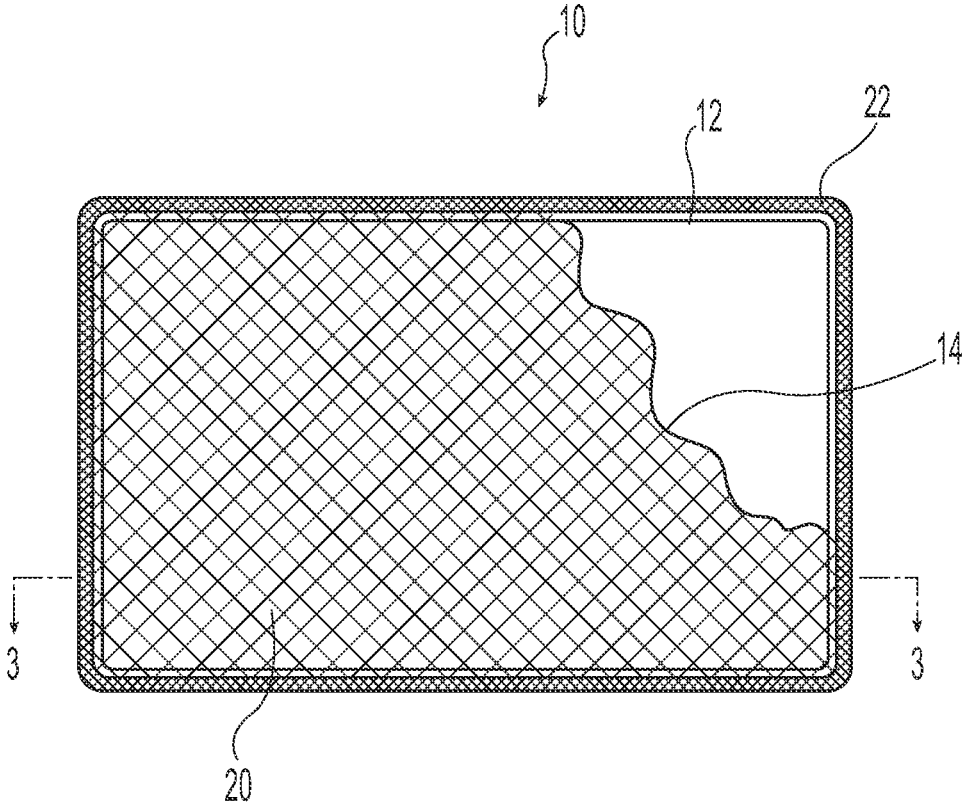
FIG. 1 is a top view of a mattress according to one embodiment of the present invention wherein the covering of the mattress is partially cut away.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Referring first to FIGS. 1-3 and 4A-4B, mattress 10 in accordance with one embodiment of the present invention is illustrated. Mattress 10 generally includes core 12 and covering 14, which surrounds core 12. Core 12 is formed of any padding material suitable for use in mattresses. Such padding material may include, for example, various urethane foams, densified polyester batting, silicone foam, neoprene foam, cotton batting, or mixture thereof. The padding material may be formed using any means including, for example, vertical folding technology developed by, and the product of which is available from, Shinih Enterprise Co., Ltd (Taipei, TW). Mattress could also be made in accordance with our co-pending application Ser. No. 11/906,848 filed Oct. 4, 2007; the subject matter of which is incorporated herein be reference.

Covering 14 includes inner surface 16, which is disposed proximal to core 12, and opposing outer surface 18. Covering 14 is formed of a transparent or translucent, flexible fabric through which core 12 and inner surface 16 are visible. In addition, the fabric of covering 14 is of a strength and resiliency to resist tears under normal use. Such a fabric may include polyurethane, weldable vinyl, thermoplastic urethanes, or nylons with weldable backing. The fabric of covering 14 may further include rip-stop pattern 20 woven therein to further resist tears. Rip-stop pattern 20 is formed of string fibers, such as nylon, woven at regular intervals into the fabric of cover 14. Rip-stop pattern 20 further resists tears and prevents the spread of small tears, thus making it difficult for a person to intentionally tear mattress 10. Covering 14 may also be capable of filtering UV (ultraviolet) light (i.e. preventing UV light rays from passing through covering 14 and reaching inner surface 16 of covering 14 and/or core 12). Covering 14 is sealed about core 12 by sealing seams 22 together using any suitable means including, for example, heat sealing, thermal or sonic welding, adhesive bonding, and/or chemical bonding.

Figure 2:
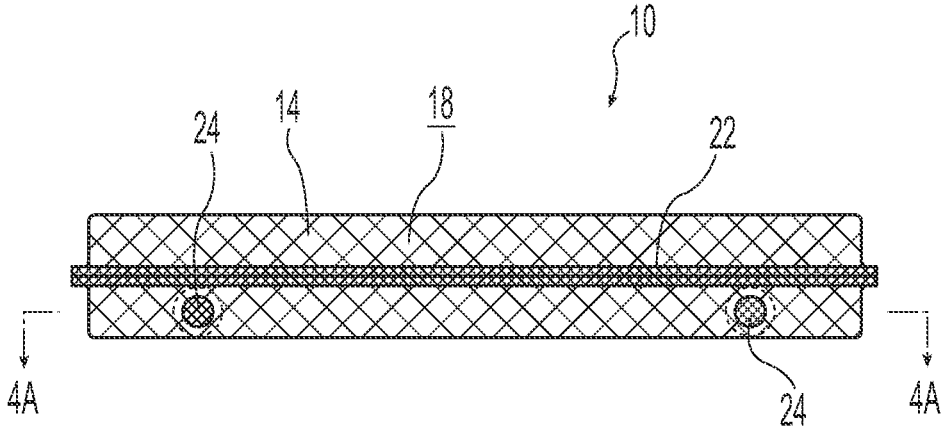
FIG. 2 is a side view of the mattress of FIG. 1.
Figure 3:
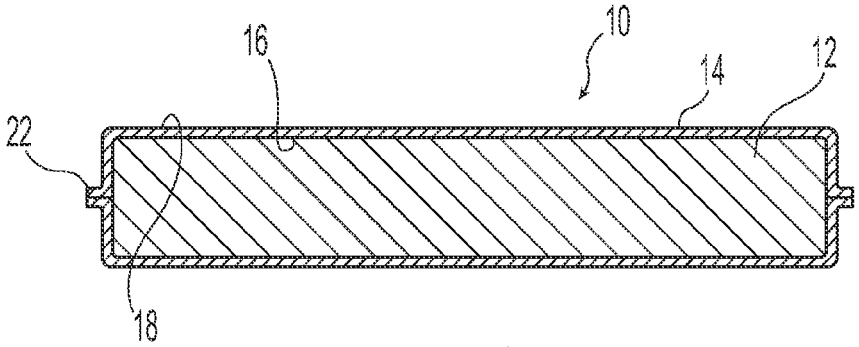
FIG. 3 is a sectional view of the mattress of FIG. 1 taken along lines 3-3.
Figure 4A:
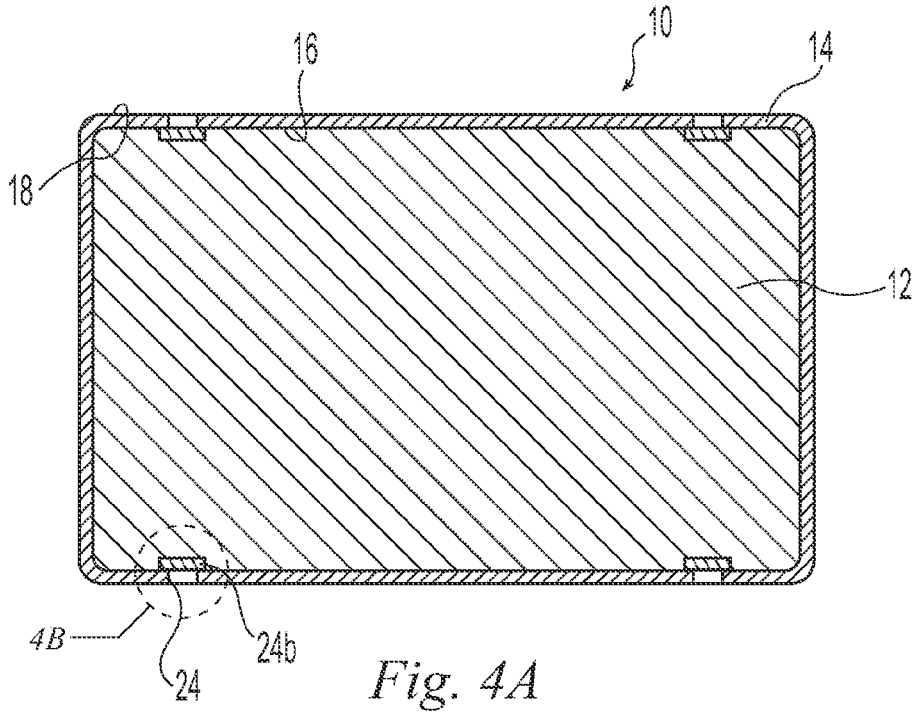
FIG. 4A is a sectional view of the mattress of FIG. 2 taken along lines 4-4.
Figure 4B:
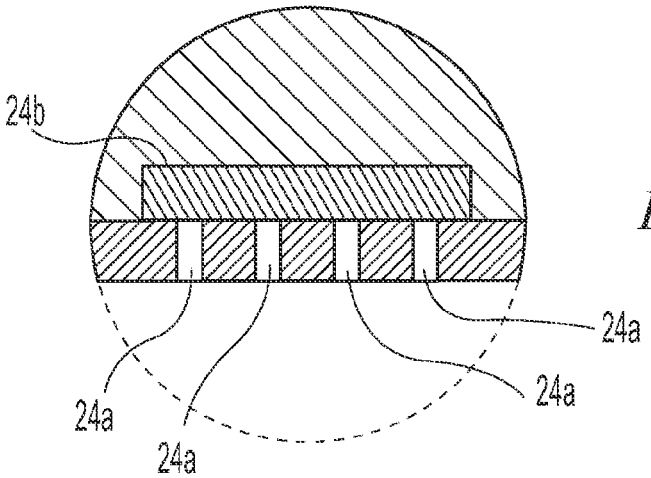
FIG. 4B is an enlarged view of the encircled region of the mattress of FIG. 4A.

Turning specifically to FIGS. 2 and 4A-4B, mattress 10 also includes vents 24, which provide ventilation through covering 14 between core 12 and the air outside of mattress 10. Vents 24 include a plurality of vent holes 24*a* extending through covering 14 and microporous membrane 24*b* positioned over holes 24*a* and sealed to inner surface 16 of covering 14. Vent holes 24*a* may be of any size sufficient to allow ventilation (i.e. the passage of air) between core 12 and the air outside mattress 10. In some cases, it may be desirable to employ minimally sized vent holes 24*a*. For example, in one embodiment vent holes 24*a* may be between 0.001 inches and 0.05 inches (0.0254 mm-1.27 mm) in diameter. However, this is only an exemplary embodiment and, as mentioned above, the size of vent holes 24*a* may vary.

Vents 24 may be constructed by any suitable method. In one exemplary method, vents 24 are constructed by, first, forming holes 24*a* in covering 14 using any known method including, for example, stamping, drilling or stitching. In one particular embodiment, vent holes 24*a* are formed using a drill press having a plurality of drill bits or tips, which are spaced apart from one another but closely toleranced. The drill bits penetrate or puncture covering 14 to, thereby, form a pattern of closely spaced vent holes. The pattern of vent holes 24*a* may have any shape and form. Next, microporous membrane 24*b* is positioned over the pattern of vent holes 24*a* and may be sealed to covering 14 using any sealing technique including, for example, heat sealing, thermal or sonic welding, adhesive bonding, double-sided adhesive strips and/or chemical bonding.

Figure 6A:
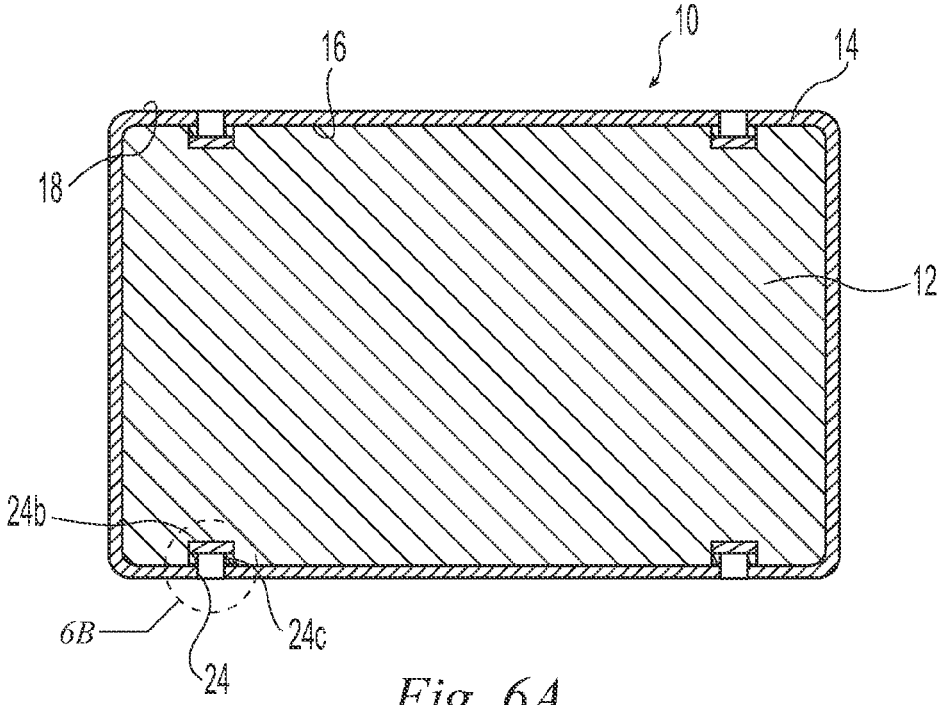
FIG. 6A is a sectional view of a mattress according to another embodiment of the present invention.
Figure 6B:
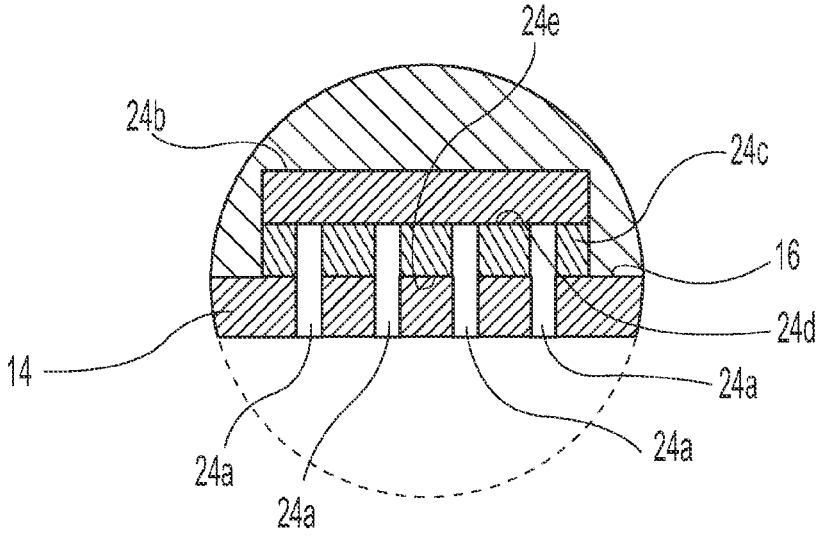
FIG. 6B is an enlarged view of the encircled region of the mattress of FIG. 6B.

Referring now to FIGS. 6A and 6B, vents 24 may alternatively be formed by, first, adhering double-sided adhesive strip 24*c* to inner surface 16 of covering 14. Adhesive strip 24*c* may be any suitable type of double-sided adhesive strip including, for example, double-sided foam tape. Adhesive strip 24*c* includes opposing surfaces 24*d*, 24*e*, each of which is coated with adhesive. Prior to use, each of adhesive surfaces 24*d*, 24*e* is covered with a piece of tape to cover and protect the adhesive until ready for use. To adhere adhesive strip 24*c* to inner surface 16 of covering 14, the tape (not shown) is removed from surface 24*e* of strip 24*c* to expose the adhesive. Adhesive surface 24*e* is pressed against inner surface 16 of covering 14 to adhere strip 24*c* to inner surface 16. Next, vent holes 24*a* are formed through both covering 14 and strip 24*c* using any method including, for example, stamping, drilling or stitching. Microporous membrane 24*b* is then adhered to surface 24*d* of adhesive strip 24*c*, by removing the protective tape (not shown) to expose the adhesive surface 24*d* and pressing microporous membrane 24*b* against surface 24*d*.

Microporous membrane 24*b* may be an oliophobic and hydrophobic membrane that allows the passage of air flow in any direction, but prevents the passage of fluids, such as water, oil and bodily fluids, in a direction toward core 12. Such a membrane may include Versipor available from Pall Specialty Materials of Port Washington, N.Y. Microporous membrane 24*b* may be sealed to outer surface 18 of covering 14 in addition to or in the alternative to inner surface 16.

It should be appreciated that the vents, given that they are provided in a high density pattern, could be provided in such a manner that they are configured as indicia. These indicia could be trademarks or logos or any other configuration. The material comprising the logos or other configuration could be formed from any material.

Mattress 10 is also equipped with a mechanism for detecting when tears have been made in covering 14. More particularly, in one embodiment, inner surface 16 is impregnated or coated with a color change composition. The color change composition provides inner surface 16 with an initial color. The initial color may be any color or may be clear. The color change composition is adapted to change the initial color to an activated color when covering 14 has been torn or penetrated. Activated color may be any color provided that the activated color is visibly and noticeably different from the initial color. Because covering 14 is transparent or translucent and inner surface 16 is visible through covering 14, activated color is also visible through covering 14. Color change composition may be any composition capable of changing colors when covering 14 is pierced, torn or penetrated. For instance, color change composition may be a photochromic dye, such as an aryl substituted heterocycle available from Color Change Corporation of Streamwood, Ill.

Figure 5:
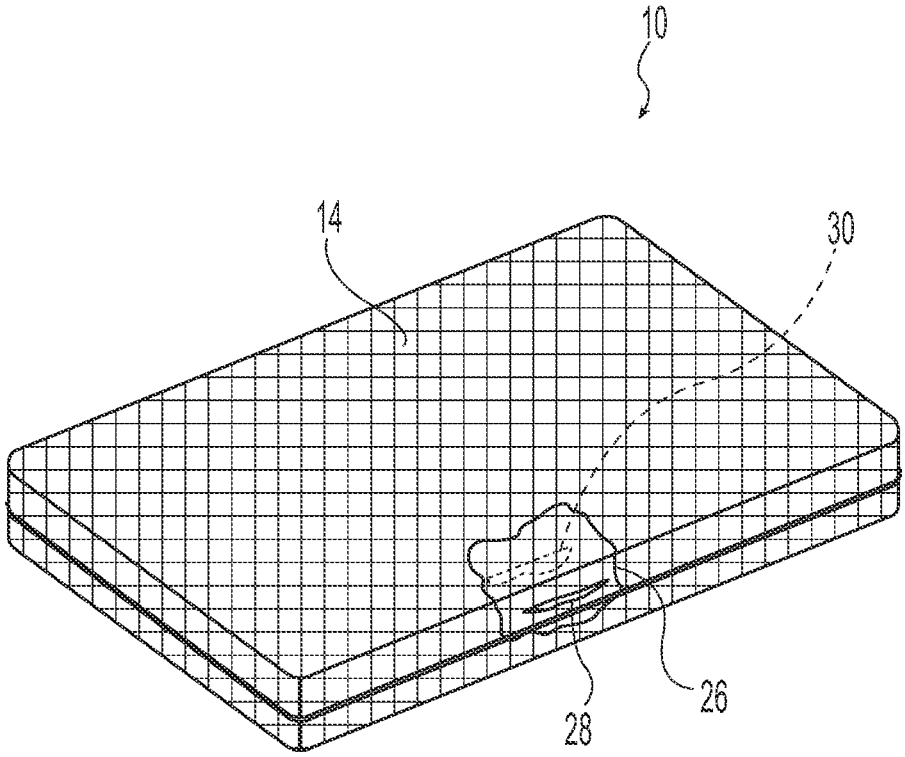
FIG. 5 is a perspective view of the mattress of FIG. 1 wherein an alteration in the mattress has been detected.

In this case, the color change composition changes from the initial color to the activated color when exposed to UV light. Accordingly, because covering 14 filters UV light, inner surface 16 and the color change composition impregnated therein is shielded from UV light and remains the initial color. However, as shown in FIG. 5, when a tear 28 is made through covering 14, UV light is permitted to pass through tear 28 thereby exposing the color change composition to the UV rays. As a result, the color change composition and inner surface 16 change to activated color 26 in the area of tear 28 thereby detecting the tear 28 and alteration in mattress 10. The activated color 26 is visible through covering 14 so as to provide a visible alert of tear 28.

In practical use, mattress 10, shown in FIG. 5, may be provided to inmates at a correctional facility, such as a prison, jail, juvenile detention center or other like facility. When an inmate attempts to hide contraband, such as knife 30, in mattress 10, the inmate attempts to cut or tear covering 14. Rip-stop pattern 20 serves as a first line of defense by making it difficult for the inmate to successfully tear covering 14. In the event the inmate is successful in creating tear 28 in covering 14 and inserting knife 30 into core 12 (FIG. 1) of mattress 10, the color change composition acts as a second line of defense by providing a visible alert of tear 28. For instance, during a routine or for cause check or "shake-down" of the inmate's cell the correctional officers can strip mattress 10 of any sheets or blankets and expose mattress 10 to UV light. The UV light rays can now penetrate covering 14 through tear 28. The UV light rays reach inner surface 16 and cause the color change composition to change from the initial color to activated color 26 in the region of tear 28. The correctional officers can view activated color 26 through covering 14 and, thereby, identify the location of tear 28 and contraband 30.

In the embodiments described above, the color change composition is impregnated in or coated on inner surface 16 of covering 14. However, it should be understood that core 12, in addition or in the alternative to inner surface 16, may be impregnated with the color change composition. In this case, core 12 would exhibit the activated color when the UV light rays penetrate the tear and reach core 12.

Although the embodiments described above use a photochromic dye as the color change composition, the present invention also contemplates using other suitable color changing dyes. For instance, hydrochromic or piezochromic dyes may be used to detect moisture or pressure changes within mattress 10. Color change dyes may also be developed and used for detecting particular types of contraband. For instance, a color change composition adapted to change color upon contact with metal may also be used.

In yet another embodiment, mattress 10 may also include an integrated pillow (not shown) protruding from core 12 and formed of padding material similar to that of core 12. It may be desirable to form the integrated pillow of a padding material having a density lesser than that of the material of core 12 to provide a softer, more pliable pillow. The integrated pillow would be covered by covering 14, and may include the mechanisms for resisting and detecting tears, as discussed above. In this embodiment, inmates and other users may be prevented from concealing contraband in their pillow because the pillow is integrated with the mattress and is provided with the same alteration detection mechanisms.

Figure 7:
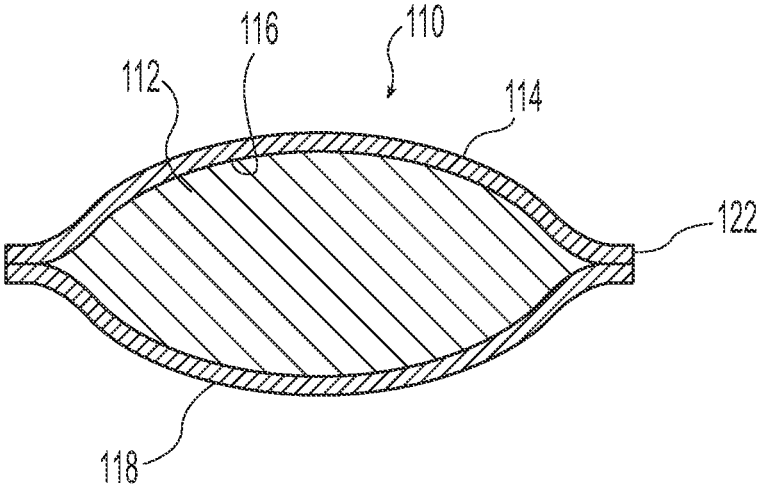
FIG. 7 is a sectional view of a pillow according to one embodiment of the present invention.

It should also be understood that the concepts of the present invention are not limited in application to just mattresses. For instance, referring to FIG. 7, the concepts of the present invention may be adapted to form a pillow, such as pillow 110. Pillow 110 generally includes core 112 and covering 114, which surrounds core 112. Core 112 is formed of padding material such as urethane foams, densified polyester batting, silicone foam, neoprene foam, cotton batting or mixture thereof.

Covering 114 includes inner surface 116, which is disposed proximal to core 112, and opposing outer surface 118. Similar to covering 14 of mattress 10 (FIG. 1), covering 114 is formed of a transparent or translucent, flexible fabric through which core 112 and inner surface 116 are visible. In addition, the fabric of covering 114 is of a strength and resiliency to resist tears under normal use and may include a rip-stop pattern (not shown) woven therein to further resist tears. Covering 114 is sealed about core 112 by sealing seams 122 together using any suitable means including, for example, heat sealing, thermal or sonic welding, adhesive bonding, and/or chemical bonding.

Pillow 110 may also include vents (not shown), which provide ventilation through covering 114 between core 112 and the air outside of pillow 110. As described above with respect to mattress 10 (FIG. 1), pillow 110 inner surface 116 and or core 112 may be impregnated or coated with a color change composition to provide an means for detecting alteration of pillow 110.

Finally, either of these items can be profiled for easy shipping, by compressing the items to deflate the foam, and then covering the vent with a covering tape. The tape holds the items in that compressed configuration, as the air can not refill the foam due to the lack of the suction through the vent. Removal of the tape causes the air to refill the foam and return the item to its inflated state.

Figures 8, 9:
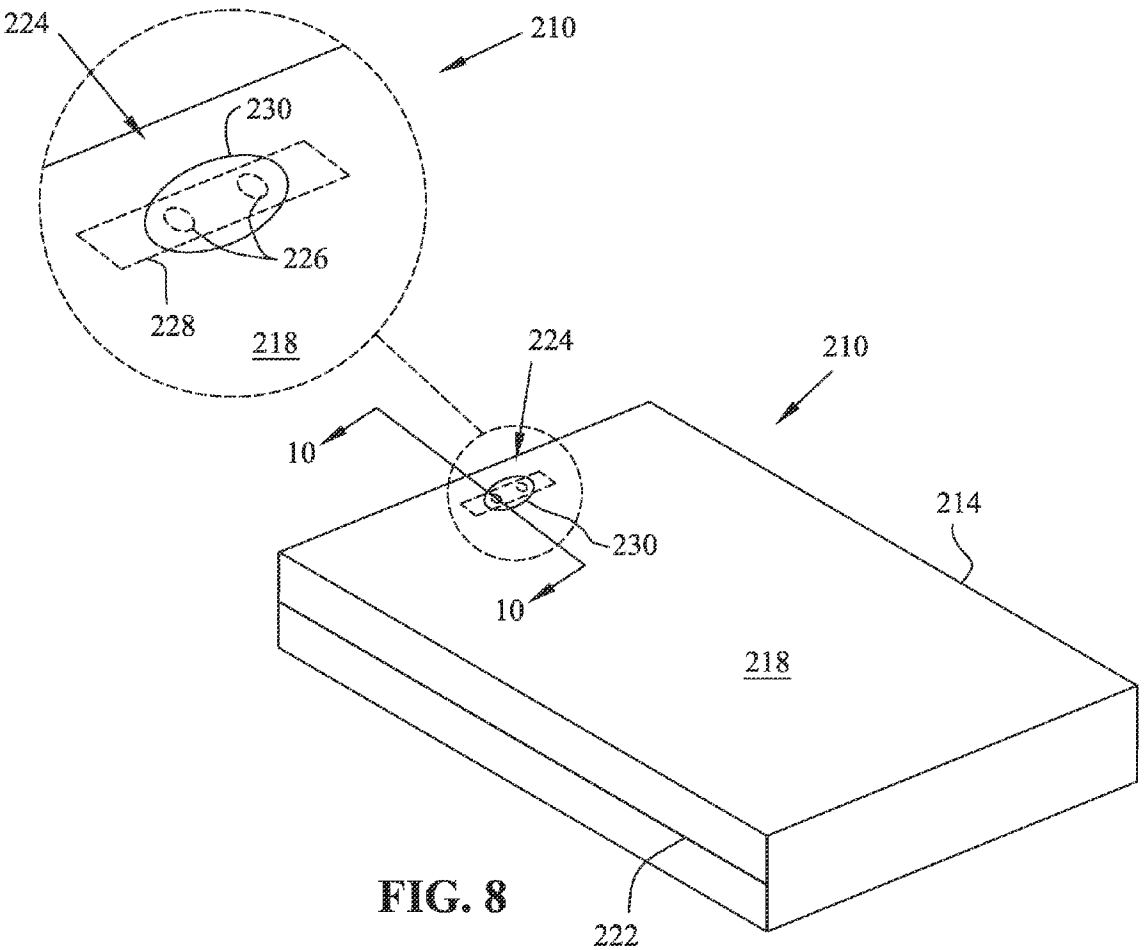
FIG. 8 is a perspective view of a mattress according to another embodiment of the present invention.
FIG. 9 is an enlarged view of the encircled region of the mattress of FIG. 8.

With reference now to FIG. 8, another embodiment of mattress is illustrated as 210. Mattress 210 generally includes core 212 (FIG. 10) and covering 214, which surrounds core 212, and vent 224. Similar to previous embodiments, core 212 may be formed of any padding material suitable for use in mattress 210. Such padding material may include, for example, various urethane foams, densified polyester batting, silicone foam, neoprene foam, cotton batting, or mixture thereof. Covering 214 includes inner surface 216 (FIG. 10) and outer surface 218. Inner surface 216 may include nylon; outer surface 218 may include polyurethane.

As shown in FIG. 9, vent 224 includes at least one hole 226 through covering 214, and a microporous membrane 228. Vent 224 provides ventilation through covering 214. Vent 224 may include a plurality of holes 226 extending through cover 214 and with microporous membrane 228 positioned over holes 226. Microporous membrane 228 may be fastened to inner surface 216 (FIG. 10) using any suitable means including, for example, heat sealing, thermal or sonic welding, adhesive bonding, and/or chemical bonding. Microporous membrane 228 may be comprised of any suitable filter as described herein, but in this embodiment, membrane 228 is from Pall Life Sciences, Part #E01008E.

Overlay 230 may be fastened to covering 214 using any suitable means including, for example, heat sealing, thermal, RF or sonic welding, adhesive bonding, and/or chemical bonding. Overlay 230 may cover at least one hole 226. While overlay 230 is not part of the vent 224, it cosmetically covers the vent 224 and is breathable. Overlay 230 may be comprised of multiple possible materials, such as leather, cloths, or micro-suede, although micro-suede is preferred for its cosmetic look and feel, its workability and for its breathability. Overlay 230 can also be configured as an indicia. This indicia could be trademarks or logos or any other configuration.

Figure 10:
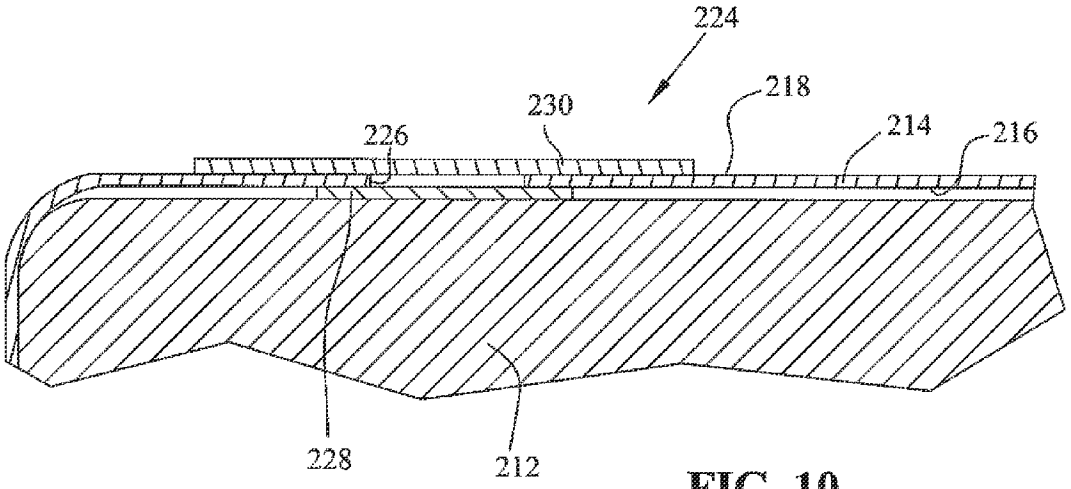
FIG. 10 is a sectional view of the mattress of FIG. 8 taken along lines 11-11.

Referring now to FIG. 10, mattress 210 is shown including vent 224 in cross-section. Cover 214 is shown with inner surface 216 and outer surface 218. Cover 214 may include a plurality of layers to include inner surface 216 and outer surface 218. Inner surface 216 may include nylon; outer surface 218 may include polyurethane. Overlay 230 is shown adjacent to and covering vent holes 226. Microporous filter 228 is shown adjacent to and covering vent holes 226.

Figure 11:
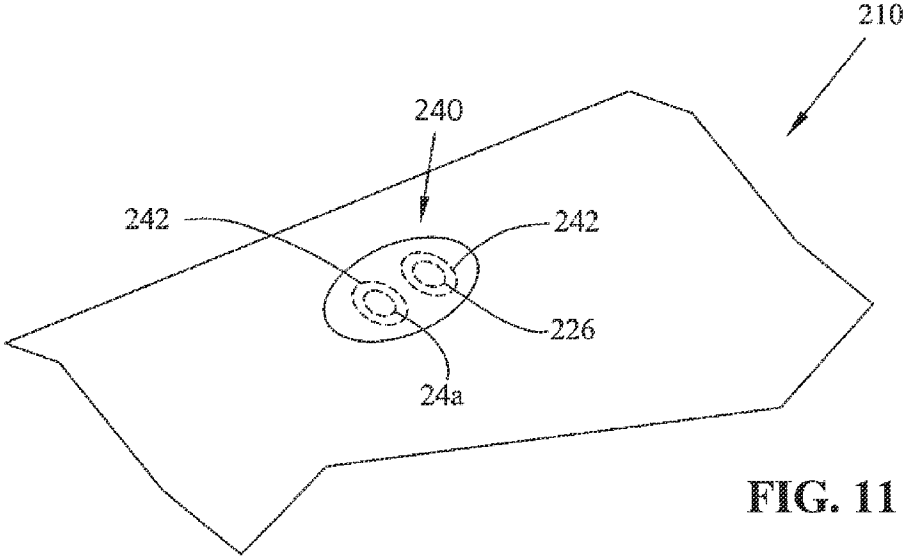
FIG. 11 is a perspective view of a mattress according to another embodiment of the present invention.

Now referring to FIG. 11, vent 240 is shown. Vent 240 is substantially similar to vent 224 except for the following difference. As illustrated, filters 242 are circular or cylindrical in shape and are large enough to substantially cover vent holes 226. Filters 242 attempt to minimize waste of filter material by substantially covering vent holes 226 without much excess. Filters 242 may be fastened to cover 214 in the same manner as filters 228 as previously disclosed.

With the components as described, the assembly of the mattress will be described. Referring back to FIG. 8, cover 214 is sealed by sealing seams 222 together using any suitable means including, for example, heat sealing, sewing, thermal or sonic welding, adhesive bonding and/or chemical bonding. It should be noted that the additional fabric of cover 214 in relation to seam 222 may be located in the interior or exterior of mattress 210 or both.

Referring now to FIG. 12, cover 214 is shown as a single sheet, prior to its formation. Inner surface 216 of covering 214 is shown. Outer surface 218 (FIG. 18) is illustrated as on the bottom side of cover 214. Vent 224 is illustrated as including at least one hole 226 extending through covering 214. Microporous membrane 228 is illustrated as positioned adjacent to and covering vent holes 226 and is illustrated as sealed to inner surface 216 of covering 214. Overlay 230 is also illustrated as positioned adjacent to and covering vent holes 226 and is also illustrated as sealed to outer surface 218 (FIG. 18) of covering 214. As shown in FIG. 12, lines 231 illustrate a potential folding arrangement. Folding arrangement will be described in greater detail below. Other folding arrangements are considered and described as alternative folding arrangements.

Cover 214 defines slits 232 which aid in this folding arrangement. As there are alternative folding arrangements, there are also alternative slit arrangements to facilitate in alternative folding arrangements. Vent 224 is located within portion 234 of cover 214. In one embodiment of a folding arrangement, portion 236 folds under portion 234 along arrow 238. Now referring to FIG. 13, slits 232 are disclosed in greater detail. As illustrated, slits 232 define flaps 240.

As shown in FIG. 14, folded cover 214 is shown. Under this folding arrangement, inner surface 216 is shown exposed and outer surface 218 (FIG. 18) is enclosed. The longitudinal sides of portions 234 and 236 are substantially adjacent in this folding arrangement. As illustrated, the longitudinal sides are seamed to the outside, creating seams 222. In an alternative folding arrangement, longitudinal sides of portions 234 and 236 are seamed to the interior of cover 214.

Seams 222 may extend onto flaps 140. As illustrated, portion 242 is not seamed. In an alternative folding arrangement, portion 242 of cover 214 may be partially vertical as illustrated in its folding pattern. As shown in FIG. 15, portion 242 may bulge or provide an opening 244 to the interior of cover 214. In an alternative folding arrangement, flaps 240 may be placed within openings 244. Referring back to FIG. 14, seam 222 extends along the length of the sides of portions 234 and 236, including adjacent to portion 246.

Now referring to FIG. 16, flaps 240 are placed in close relationship to portion 242. In an alternative folding arrangement, flaps 240 are sealed to portions of 242. Referring now to FIG. 17, slits 232 (FIG. 12) define edges 241 of flaps 240 to be placed adjacent to portion 242. It is recognized that any suitable seaming slip pattern, any suitable folding arrangement, or seaming pattern is possible where appropriate.

Figure 20:
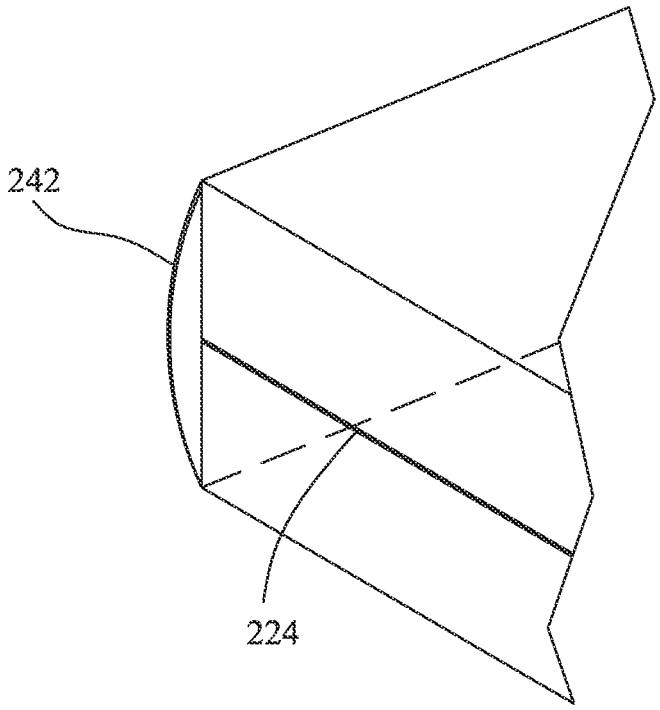
FIG. 20 is a perspective view of the mattress of FIG. 18 wherein the cover has been inverted.
Figure 21:
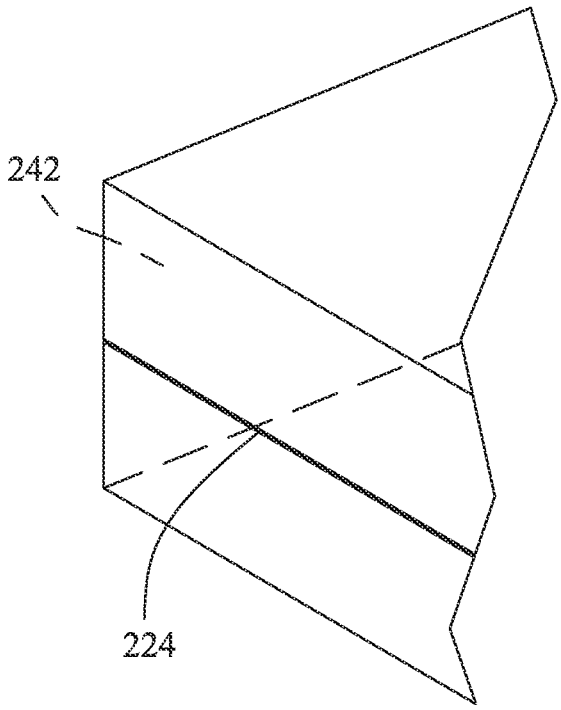
FIG. 21 is a perspective view of the mattress of FIG. 20 wherein a portion of the cover has been fastened to the rest of the cover.

Now referring to FIG. 18, cover 214 may be turned inside out as illustrated by arrow 246. Turning cover 214 inside out exposes outer surface 218 and overlay 230. Turning cover 214 inside out also encloses outwardly directed seams 222 as best illustrated by FIG. 19. Turning cover 214 inside out also exposes inside seam 224. Where the folding arrangement is such that flaps 240 were not seamed to portion 242, portion 242 is shown in FIG. 20 bulging away from the rest of cover 214. Portion 242 may be seamed to the rest of cover 214 as shown in FIG. 21.

Now referring to FIG. 22, core 212 is shown as configured to be inserted into the interior of cover 214 along arrow 248. As previously mentioned, this is only one of several potential folding patterns.

Referring now to FIG. 23, mattress 210 is shown including outwardly seamed edge 224 for one side. The other seamed portions are shown as inwardly seamed edges 222, as best shown in FIG. 24.

Figure 25:
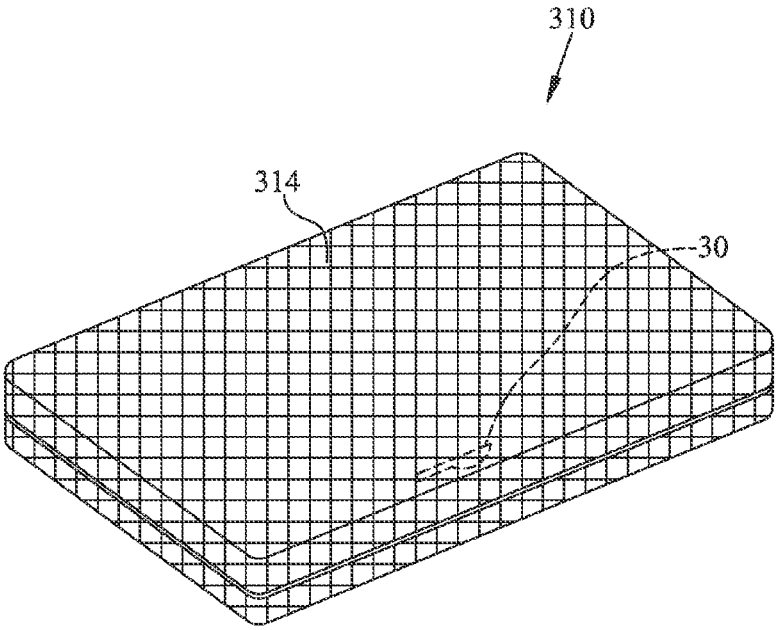
FIG. 25 is a top view of a mattress according to another embodiment of the present invention.
Figure 26:
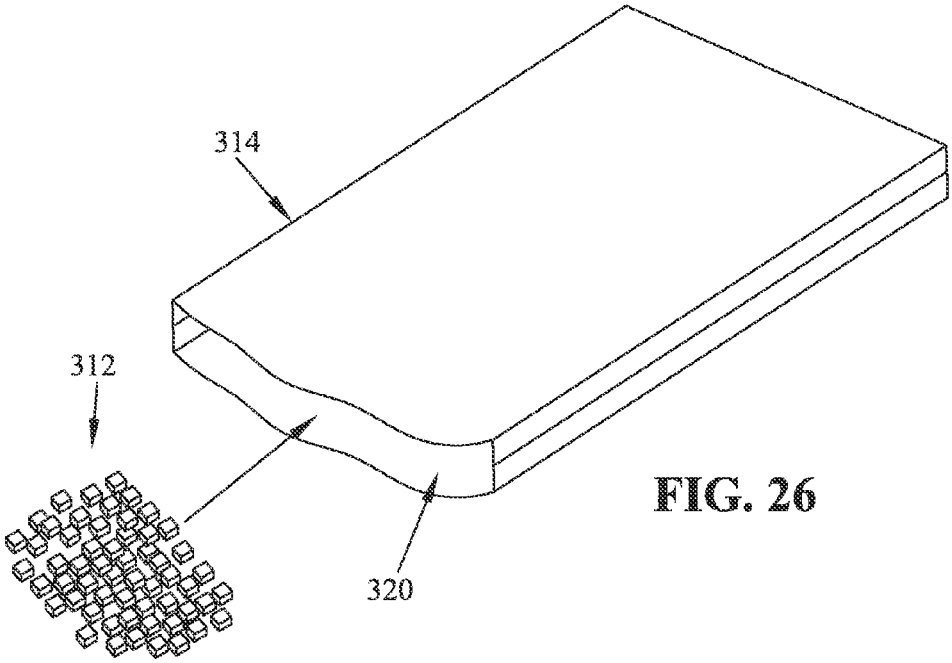
FIG. 26 is a view of the mattress of FIG. 25 partially assembled.

With respect now to FIGS. 25 and 26, another embodiment of the present mattress is shown. As shown in FIG. 25, mattress 310 is shown having an outer covering 314. In this embodiment, covering 314 is also a transparent or translucent material similar to any of the materials discussed herein, and may or may not include a rip stop pattern 16 as also described about. In this embodiment, stuffing 312 is provided to fill cavity 320 of mattress cover 314. In this embodiment, stuffing 312 is also transparent or translucent and could be comprised of foam, fiber, woven plastics, bubble wrap, gel beads, air pockets, densified fibers, and/or a combination of two or more of the above. As such, the entire mattress is transparent or translucent such that contraband (such as knife 30) can be seen directly through the mattress while the mattress is in a fully assembled condition.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A mattress comprising:

a core formed of a transparent or translucent padding material comprised of at least one of foam and fiber; and a translucent covering surrounding said core, the covering having a top surface comprising a translucent material and a bottom surface comprising the translucent material, the covering defining a cavity and the transparent or translucent padding filling the cavity such that the entire mattress is translucent when the mattress is in a fully assembly condition.

2. The mattress of claim 1, wherein the translucent material comprises polyurethane.

3. The mattress of claim 2, wherein the covering includes a rip stop pattern woven therein.

4. The mattress of claim 1, wherein said fiber is in the form of fiber batting.

5. The mattress of claim 1, wherein said fiber is in the form of densified fiber.

6. The mattress of claim 1, wherein said transparent or translucent padding includes a plastic material.

7. The mattress of claim 6, wherein said transparent or translucent padding includes woven plastics.

8. The mattress of claim 6, wherein said transparent or translucent padding includes a bubble wrap.

9. The mattress of claim 1, wherein said transparent or translucent padding includes a gel material.

10. The mattress of claim 9, wherein said gel material is in the form of gel beads.

11. The mattress of claim 1, wherein said transparent or translucent padding includes air pockets.

12. The mattress of claim 1, further including at least one vent extending through said covering and providing ventilation between said core and the environment outside of the mattress.

13. The mattress of claim 12, wherein the at least one vent includes a plurality of circular openings extending through the covering.

14. The mattress of claim 12, further comprising at least one filter coupled to the covering at a general position of the at least one vent.

* * * * *